US005896728A

United States Patent [19]

Domino et al.

[11] Patent Number: 5,896,728

[45] Date of Patent: Apr. 27, 1999

[54] AIR JET APPARATUS FOR RE-OPENING CARTONS

[75] Inventors: Bruce D. Domino, Nisswa; Cory E. Hawley, Aitkin, both of Minn.

[73] Assignee: Riverwood International Corp., Atlanta, Ga.

[21] Appl. No.: 08/827,046

[22] Filed: Mar. 25, 1997

[51] Int. Cl.[6] ..... B65B 5/06; B65B 43/36; B65B 21/08

[52] U.S. Cl. ..... 53/458; 53/492; 53/566; 53/252; 53/385.1

[58] Field of Search ..... 53/458, 381.4, 53/382.1, 385.1, 251, 252, 566, 492, 468, 447, 540

[56] References Cited

U.S. PATENT DOCUMENTS

| | | | |
|---|---|---|---|
| 3,728,945 | 4/1973 | Vuilleumier | 53/385.1 X |
| 3,753,331 | 8/1973 | Sato | 53/382.1 X |
| 4,018,031 | 4/1977 | Smaw | 53/385.1 X |
| 4,149,356 | 4/1979 | Palmer | 53/385.1 X |
| 4,358,918 | 11/1982 | Groom et al. | 53/566 X |
| 4,393,640 | 7/1983 | Cole et al. | 53/385.1 X |
| 5,241,806 | 9/1993 | Ziegler et al. . | |
| 5,361,562 | 11/1994 | Nagaoka et al. | 53/381.4 |
| 5,456,058 | 10/1995 | Ziegler . | |
| 5,561,968 | 10/1996 | Palmer | 53/566 X |
| 5,572,852 | 11/1996 | Crystal et al. . | |
| 5,588,276 | 12/1996 | Terjung et al. | 53/566 X |
| 5,660,022 | 8/1997 | Lade et al. | 53/566 X |

*Primary Examiner*—Horace M. Culver
*Attorney, Agent, or Firm*—Skinner & Associates; Steve M. McLary

[57] ABSTRACT

An air jet carton reopening apparatus for use with an article cartoning machine. The apparatus produces a stream of pressurized gas or a gas mixture that opens carton sleeves to receive articles for packaging. The air jet apparatus comprises a gas emitting mechanism, a gas supply connected to the gas emitting mechanism, and a positioning mechanism constructed and arranged to dispose the gas emitting mechanism operationally adjacent to the carton sleeves. The stream of pressurized gas is directed at the carton sleeve such that it opens and maintains the relatively rectangular dimensions of the carton sleeves to permit the article cartoning machine to successfully load articles into an optimally sized carton.

17 Claims, 7 Drawing Sheets

AIR JET APPARATUS FOR RE-OPENING CARTONS

BACKGROUND OF THE INVENTION

1. Field of the Invention

The present invention relates, generally, to apparatus and methods used in the packaging industry. More particularly, the invention relates to means for successfully loading articles into optimally sized cartons. Specifically, the invention relates to means for maintaining the relatively rectangular dimensions of carton sleeves and opening the ends of carton sleeves to permit the loading of articles into optimally sized cartons. The invention has particular utility in re-opening the bowed ends of partially erected paperboard carton sleeves in continuous motion cartoner assemblies. However, the invention also may have utility in other applications.

2. Background Information

In the past, various devices and methods have been used or proposed to load article groups into carton or other packaging sleeves, blanks or wraps in a cartoner or other packaging machine. However, these devices and methods are believed to have significant limitations and shortcomings. One problem is that cartoners are periodically stopped for maintenance, product changeovers, and other reasons. After a period of idle time on a cartoner assembly, partially erected carton sleeves, particularly those constructed of paperboard, have a tendency to lean or skew from their rectangular dimensions, and the flaps of the sleeves have tendency to bow. Both the skewed carton sleeves and bowed flaps interfere with the loading of article groups. The bowed flaps can be erroneously pushed and folded into the carton with the article groups. The side walls of the skewed carton sleeves may prevent or interfere with the loading of article groups into cartons, particularly those that are optimally sized. Optimally sized cartons have dimensions that are only very slightly larger than those of the article group to be loaded so as to be taut, square, stable and so as to minimize material usage.

Examples of cartoners upon which the device of the present invention may be used are described in U.S. Provisional Application 60/016,930 (hereinafter referred to as "Provisional Application '930"), U.S. Pat. No. 5,456,058 (hereinafter referred to as "Patent '058"), and U.S. Pat. No. 5,241,806 (hereinafter referred to as "Patent '806"). Provisional Application '930, Patent '058, and Patent '806 are all assigned to applicants' assignee and are all hereby incorporated by reference.

Provisional Application '930 discloses an article group transfer mechanism constructed and arranged to move stacked article groups into open ends of carton sleeves. The mechanism is incorporated in a continuous motion cartoner assembly and is used to transfer stacked bottles into carton sleeves. In a preferred embodiment, the transfer apparatus includes a plurality of transfer elements, means for longitudinally moving the transfer elements, and a cam track assembly. The plurality of transfer elements are disposed at predetermined longitudinally spaced intervals. The transfer elements laterally move articles which are being longitudinally transported in a stream. Each transfer element includes a lower contact member and an upper stepped contact member, a support member connected to the contact members, and a control member for directing the lateral movement of the transfer elements. The control member of the transfer element includes a first cam follower connected to the support member controlling lateral movement of the transfer elements, and a second cam follower pivotally connected to the support member and connected to the contact member via linkage means. The second cam follower of the control member provides differential lateral movement between the upper and lower contact members. A third cam follower of the control member is pivotally connected to the support member and is connected to the contact member via linkage means. The third cam follower provides differential lateral movement to predetermined portions of the stepped contact member. The transfer apparatus further includes means for longitudinally moving the transfer elements, said means being connected to the support member. The transfer apparatus also includes a cam track assembly capable of laterally moving the transfer elements. The cam track assembly is cooperatively mated with the first and second cam followers.

Patent '058 discloses a continuous motion cartoner assembly for loading stacked or vertically layered article groups into cartons. This device is used to load stacked cans into carton sleeves. The cartoner assembly comprises an article infeed mechanism supplying at least two streams of articles at vertically distinct levels; an article group selection and transport mechanism intersecting the article infeed mechanism to form a longitudinal stream of article groups of a predetermined stacked pattern; a carton supply and transport mechanism synchronized and moving parallel with the article group selection and transport mechanism to provide cartons with open ends facing the moving article groups; and an article group transfer mechanism constructed and arranged to move the article groups into the open ends of the carton sleeves. This cartoner provides a method of continuously loading cartons with stacked article groups having upper and lower sub-groups of at least one article. The method comprises the steps of supplying an input stream of articles at a first location, selecting articles at the first location to form a lower article sub-group, transporting the lower article sub-groups longitudinally to a second location, supplying an input stream of articles at the second location, selecting articles at the second location to form an upper article sub-group on top of the lower article sub-group to thereby form a stacked article group, supplying and longitudinally transporting a carton in spacial synchronization with the stacked article group, and laterally transferring the stacked article group into the longitudinally transported carton.

Patent '806 discloses a cartoner assembly for loading article groups into open carton sleeves. It is used to load unstacked bottles or cans to carton sleeves. The cartoner assembly comprises an article infeed mechanism supplying at least one stream of articles, an article selection mechanism intersecting said article infeed mechanism to form and move a stream of article groups of a predetermined pattern, a carton transport mechanism synchronized and moving parallel with said article selecting mechanism to provide cartons with open ends facing said moving article groups, and an article groups transfer mechanism constructed and arranged to move article groups into the open ends of the carton sleeves. The article selection mechanism has a plurality of fixed, stationary flight bars disposed thereon which linearly select articles from the article infeed mechanism which is angled with respect to the article selection mechanism The article groups transfer mechanism has transversely reciprocating arm assemblies, including cam actuated stepped transfer heads, for loading product groups in an initially nested configuration having a differentially thinner loading dimension. The article groups transfer mechanism includes cam actuated means to guide product groups into cartons. The carton transport mechanism has improved carton flight phase adjustment means.

Despite the need in the art for a continuous motion carton assembly which overcomes the disadvantages, shortcomings and imitations of the known art, none insofar as is known has been developed. Accordingly, it is an object of the present invention to provide a cartoner that successfully loads article groups in optimally sized, taut paperboard cartons upon machine start-up after a period of idle time. Another object is to provide a mechanism that will reliably maintain the relatively rectangular dimensions of cartons sleeves and open or re-open the bowed flaps of the carton sleeves during machine operation prior to the loading of the articles into the carton sleeves.

BRIEF SUMMARY OF THE INVENTION

The present invention provides an air jet apparatus and method for opening or re-opening cartons in or on a packaging machine, such as a continuous motion cartoning apparatus. The air jet apparatus comprises a gas emitting mechanism constructed and arranged to output a stream of pressurized gas or a gas mixture such as air, a gas supply, for example an air pressure hose, and a positioning mechanism constructed and arranged to dispose the gas emitting mechanism operationally adjacent to a carton transport mechanism of the cartoning apparatus. The stream of pressurized air has sufficient force to open flaps on cartons traveling longitudinally along the carton transport mechanism. A preferred embodiment of the present invention includes an aligning mechanism and a timing mechanism constructed and arranged to direct the stream of pressurized air and to synchronize the stream with the carton transport mechanism, an article transport mechanism, and an article loading mechanism.

The power jet apparatus provides an efficient solution that allows a continuous motion cartoning apparatus to start up immediately after a period of idle time by reopening skewed carton sleeves traveling on a carton transport mechanism. The solution is efficient because it utilizes commonly available factory compressed or pressurized gas, gas mixture or air to prevent the waste of material and time related to the re-calibration or resynchronization of the article group transport mechanism, article transfer mechanism, and carton transport mechanism.

The features, benefits and objects of this invention will become clear to those skilled in the art by reference to the following description, claims and drawings.

DETAILED DESCRIPTION

The air jet mechanism or apparatus 10 is used in a continuous, high-speed cartoning apparatus or cartoner 12. The cartoners typically comprise an article infeed mechanism, an article selecting mechanism, an article group transport mechanism, an article group loading mechanism, and a carton transport mechanism. The air jet apparatus cooperates with and is synchronized to both the carton transport mechanism and article group transfer mechanism of the cartoners, and thus assists the cartoners in the successful loading of article groups into optimally sized carton sleeves that may have skewed from their rectangular dimensions either while sitting idle or traveling on the carton transport mechanism.

Figure 1:
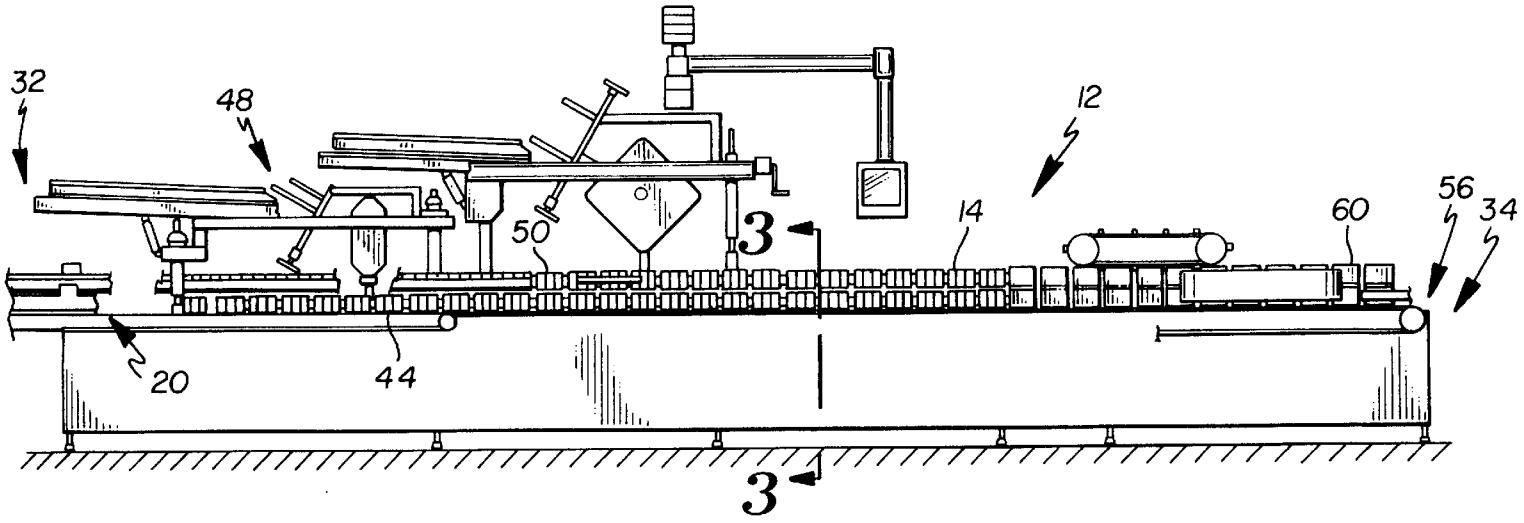
FIG. 1 is a side view of an article cartoning apparatus (Patent '058) which includes the air jet carton reopening mechanism of the present invention.
Figure 2:
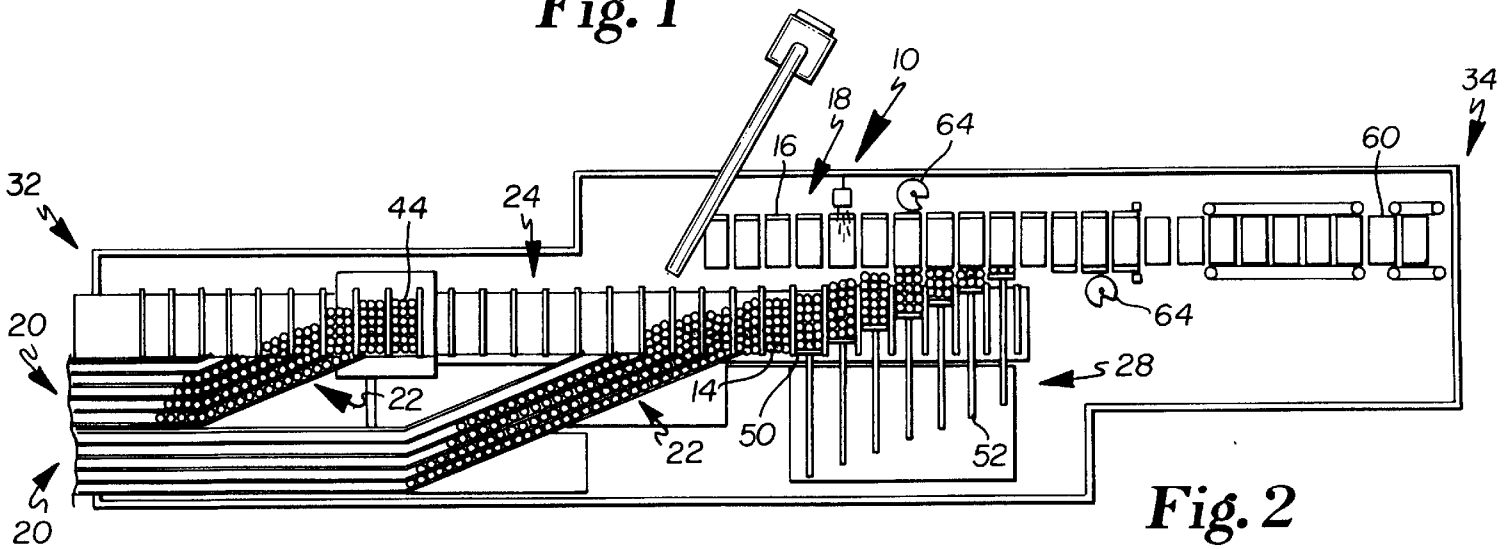
FIG. 2 is a top plan view of the cartoning apparatus of FIG. 1.
Figure 3:
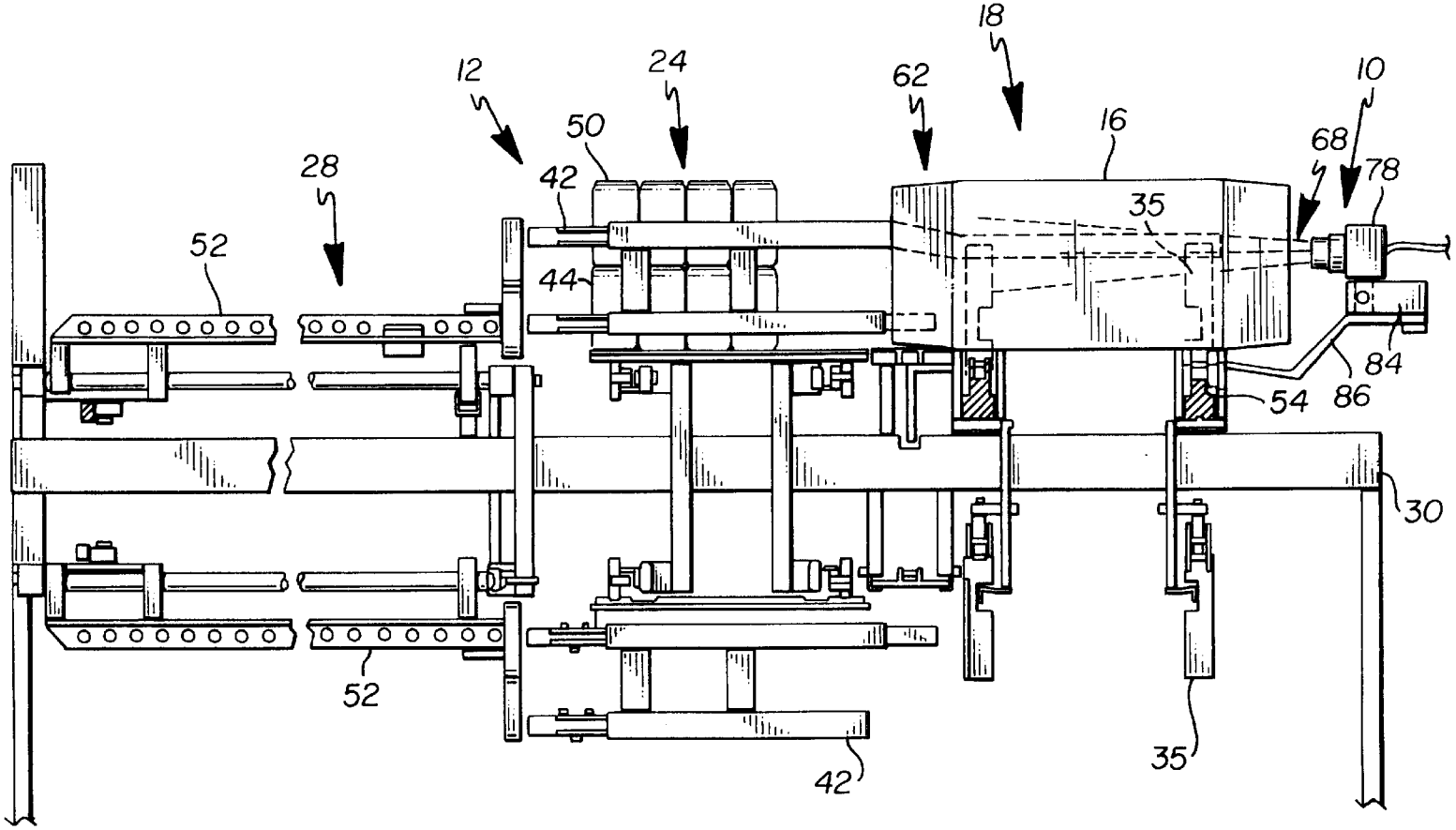
FIG. 3 is an end view of the cartoning apparatus of FIG. 1 taken along line 3—3 of FIG. 1.

FIGS. 1, 2 and 3 show the cartoner of Patent '058 loading stacked article groups 14 of cans into carton sleeves 16 and exemplify the general relationship of the air jet apparatus 10 to a cartoner 12. The cartoner 12 of Patent '058 generally comprises a carton transport mechanism 18, a pair of article infeed mechanisms 20, an article group selection mechanism 22, an article group transport mechanism 24, a divider placement mechanism 26, and an article group loading or cross loading mechanism 28. These mechanisms are supported by a unitary frame structure 30.

Carton sleeves 16 or blanks are disposed proximate to an input end 32 of the cartoner 12 and are subsequently transported in a linear fashion to an output end 34 of the cartoner 12. The article infeed mechanisms 20 are shown to be disposed at the input end 32 of the cartoner 12. A first portion 36 of each article infeed mechanism 20 is disposed spacially parallel to the article group selection mechanism 22 and the article group transport mechanism 24, and a second portion 38 merges, at a predetermined angle, with the article group transport mechanism 24 to supply streams of articles 40 to two separate positions along the article group transport mechanism 24. These merging mechanisms are further constructed and arranged to meter individual articles 40 using flight bars 42 into predetermined stacked article groups 14 on the mechanism. The stacking function of the device is accomplished by forming a first group 44 at a low level, placing a separator or divider sheet 46 on the lower group 44 via the divider sheet placement mechanism 48, and then simultaneously forming a second group 50 downstream at an upper level and allowing the second group 50 to slide across the divider sheet by the action of the flight bars 42 of the article group selecting mechanism 22. The article group transport mechanism 24 is disposed adjacent and parallel to the carton transport mechanism 18 and downstream, in a linear orientation. Merged or stacked article groups 14 are transported downstream thereon in a spaced and metered fashion, each group 14 being aligned with a carton sleeve 16 traveling on the carton transport mechanism 18. The article group loading mechanism 28 has loading arms 52 which extend transversely or perpendicularly with respect to the transport mechanisms 18 and 24, and move stacked article groups 14 on the article group transport mechanism 24 into aligned carton sleeves 16 traveling on the carton transport mechanism 18, thereby loading the carton sleeves 16 with the stacked article groups 14. Preferably, each of the aforementioned mechanisms has a conveyor type structure with an endless flight chain 54 or belt configured about rotatable drive and idler end means 56 and moves longitudinally with respect to the input 32 (upstream) and output 34 (downstream) ends of the cartoner 12. The movement of each mechanism is further synchronized with one another, for example by a common drive and/or gearing means.

Figure 4:
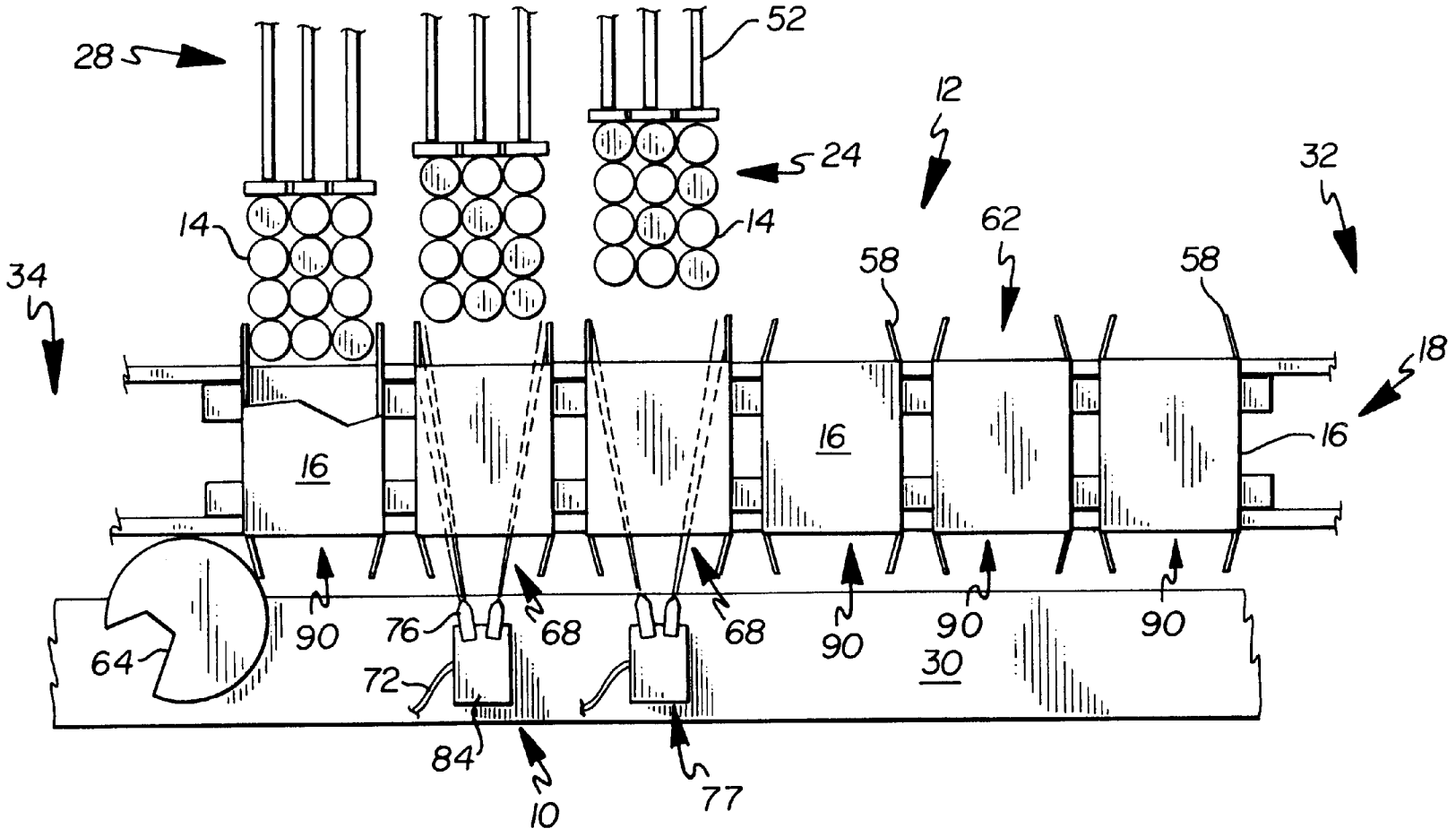
FIG. 4 is a top view of the air jet carton reopening mechanism of the present invention along with the carton transport mechanism and the article group transfer mechanism of the cartoning apparatus of FIG. 1.

FIG. 4 shows a top view of the air jet mechanism 10 and shows carton sleeves 16 that have been partially erected and have been standing for five or ten minutes on an idle carton transport mechanism 18. When the stacked article groups 14 are loaded into the carton sleeves 16 without the use of the air jet apparatus 10, the stacked article groups 14 have a tendency to erroneously catch and fold the bowed flaps 58 into the carton sleeve 16. Thus, the flaps 58 are not available to construct a carton 60. In addition, the cartoner 12 may jam while attempting to load stacked article groups 14 into skewed cartons 60.

The carton sleeves 16 are transported on the carton transport mechanism 18 downstream toward the output end 34 using flight lugs 35. The air jet apparatus 10 is positioned operationally adjacent to the carton sleeves 16 and opposite the open or loading end 62 of the carton sleeve 16 in which the stacked article groups 14 are being pushed. The air jet apparatus 10 is further positioned upstream from the point where the stacked article groups 14 are loaded into the carton sleeves 16. As shown in FIG. 4, the air jet apparatus 10 is located prior to the flap tuckers 64 such that the end panels 66 are still open. The stream of pressurized air 68 flows through the carton sleeve 16 and extends the bowed flaps 58 on the loading end 62 just prior to the moment when the article group loading mechanism 28 loads stacked article groups 14 into the carton sleeve 16. The air jet apparatus 10 is synchronized with the article group loading mechanism 28 and the carton transport mechanism 18 to provide a flow of air to reopen a carton sleeve 16 to permit a stacked article group 14 to be loaded. The air jet apparatus 10 pulsates this stream of air 68 so that the air flow does not interfere with the travel of the carton sleeves 16.

Figure 5:
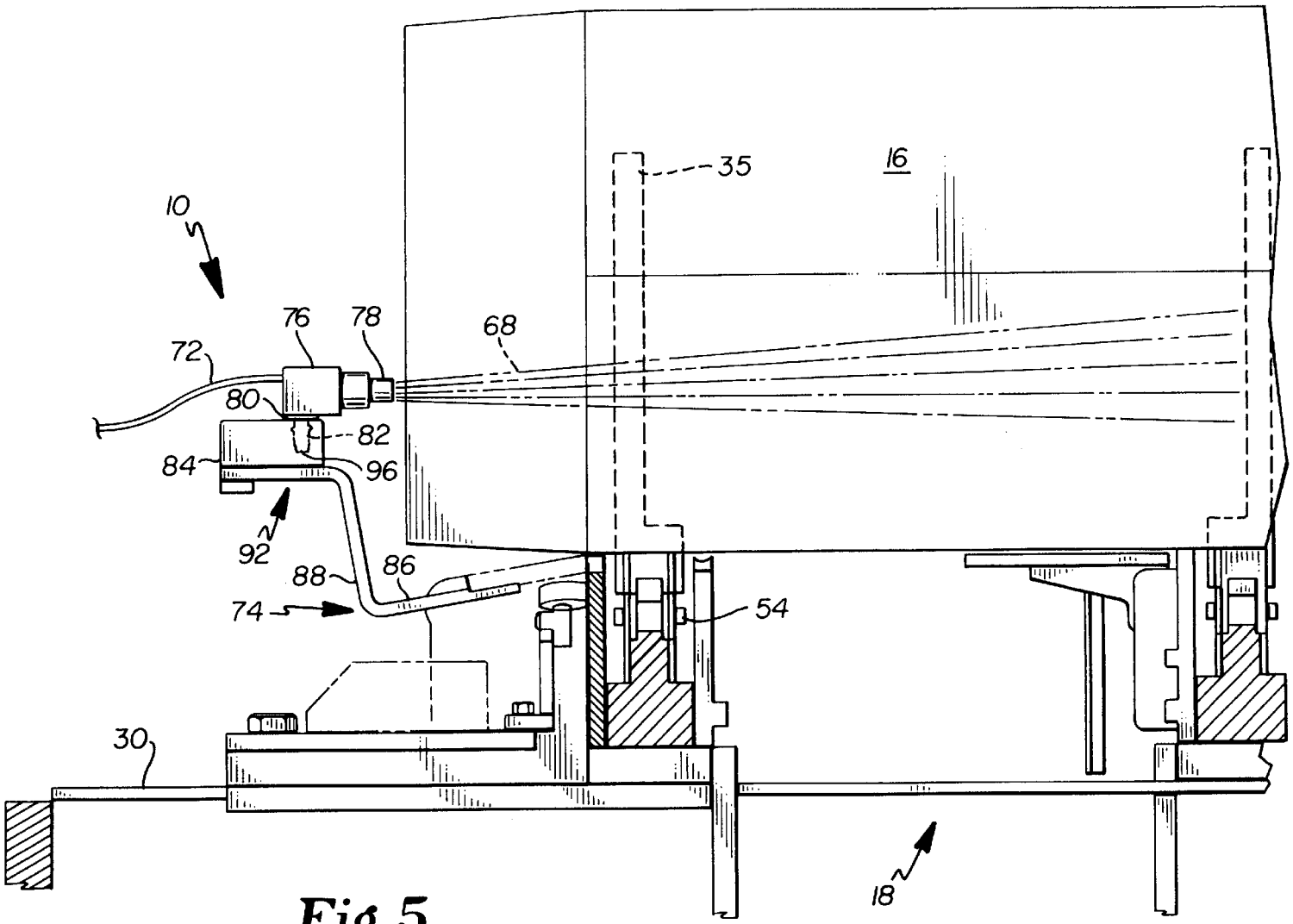
FIG. 5 is a side view showing the air jet carton reopening mechanism directing a stream of pressurized air into partially erected carton sleeves.

FIG. 5 shows a side view of the air jet apparatus 10, and in particular, it shows the gas emitting mechanism 70 connected to an air line 72 or other means to supply gas, and it shows the positioning mechanism 74 for disposing the gas emitting mechanism 70 next to the carton sleeves 16 to be re-opened.

The gas emitting mechanism 70 is shown as a set of air jet nozzles 76 connected to factory compressed air of 60–80 psi. The preferred embodiment uses air jet nozzles 76 such as the TRANSVECTOR JET™ manufactured by Vortec that produces a thin, confined air stream of a sufficient pressure to open carton sleeves 16 when the air jet nozzles 76 are set 20–23 inches, and preferably 21.5 inches, from the carton sleeves 16. The air jet nozzles 76 has a nozzle portion 78 that accurately directs the narrow stream of air, and a neck 80 that is received within a cavity 82 of a base 84.

The positioning mechanism 74 is shown as an arm attachment 86 that is bolted along the frame 30 of the carton transport mechanism 18. The arm attachment 86 takes the shape of a bracket 88 with two angles. This shape allows the arm attachment 86 to horizontally position the air jet nozzles 76 and avoid interfering with the travel of the carton sleeves 16 on the carton transport mechanism 18. As shown in FIG. 5, the positioning mechanism 74 may be attached anywhere along the frame 30. This flexibility is desirable to accommodate different types of article groups because the point where the article groups are loaded into carton sleeves 16 is dependent on the article group pattern and size of the carton. For example, FIG. 4 shows an alternative position for air jet nozzles 77. The set of air jet nozzles 76 is capable of moving to accommodate narrower or wider stations 90 associated with 12-packs, 36-packs, or other article groups of a predetermined pattern.

A preferred embodiment incorporates an aligning mechanism 92 and a timing mechanism 94. The aligning mechanism 92 allows for pivotal adjustments to set the air jet nozzles 76 in an optimal direction. As shown in FIG. 5, the air jet nozzles 76 are pivotally mounted on the positioning mechanism 74. A set screw 96 or similar device within the base 84 pins the neck 80 within the cavity 82 and provides means for setting the air jet nozzles 76 in a particular direction.

The timing mechanism 94 comprises an electronic timing device that is programmed to pulsate or operate for 200 degrees of a 360 degree cycle, although it may be programmed to operate for a different percentage of a cycle. A 360 degree cycle is defined as the period of time required for a carton sleeve 16 to advance one station 90 longitudinally along the carton transport mechanism 18. The duration of one cycle may range from 0.2 seconds to 1.2 seconds. An effective timing mechanism design for re-opening bowed and skewed paperboard carton sleeves 16 blasts a stream of air for the first five to ten cycles when the cartoner 12 is operating in the automatic mode and for every cycle when the cartoner 12 is operating in the manual mode.

Figure 6:
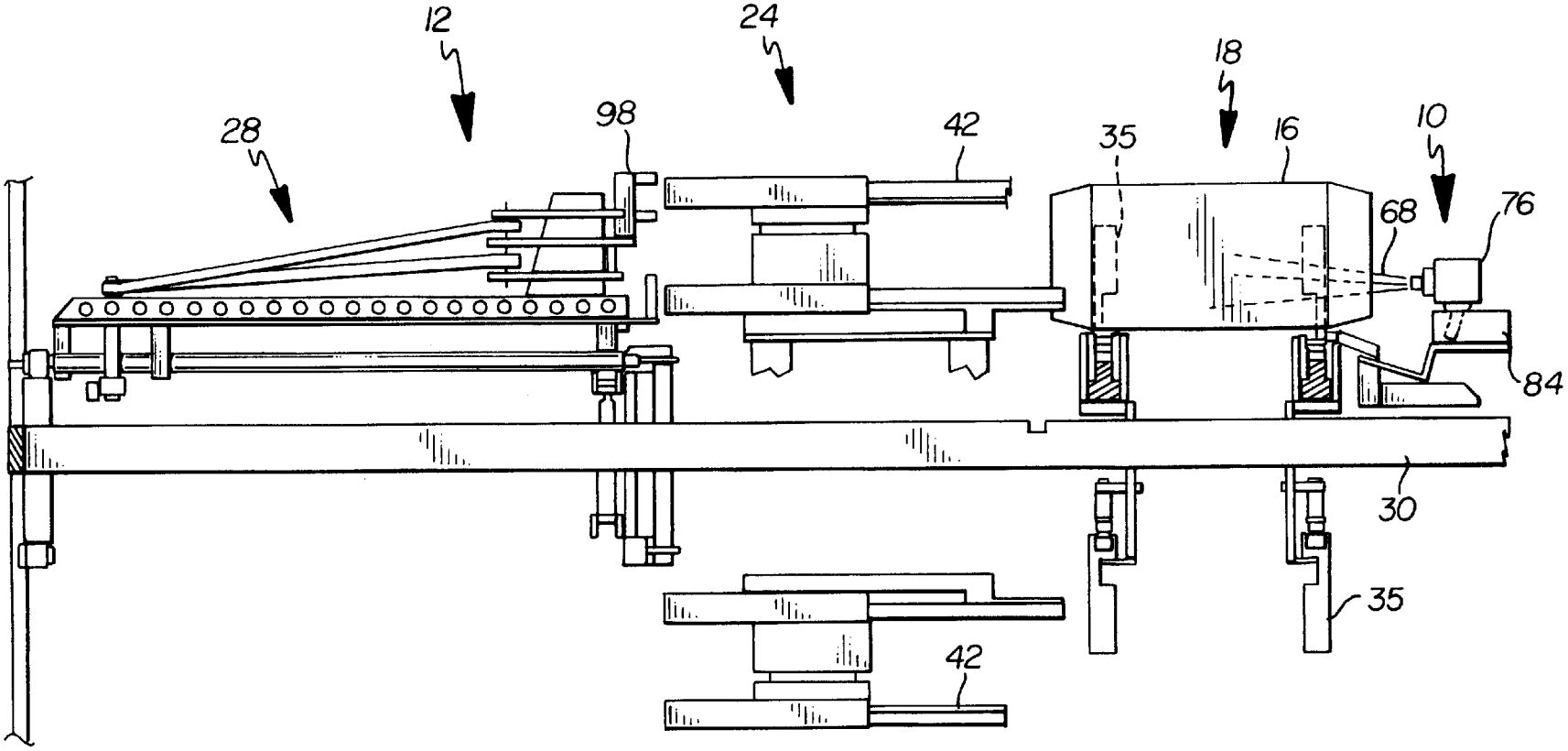
FIG. 6 is an end view of the article cartoning apparatus (Provisional Application '930), which includes the air jet carton reopening mechanism of the present invention, looking upstream toward the input end of the apparatus.
Figure 7:
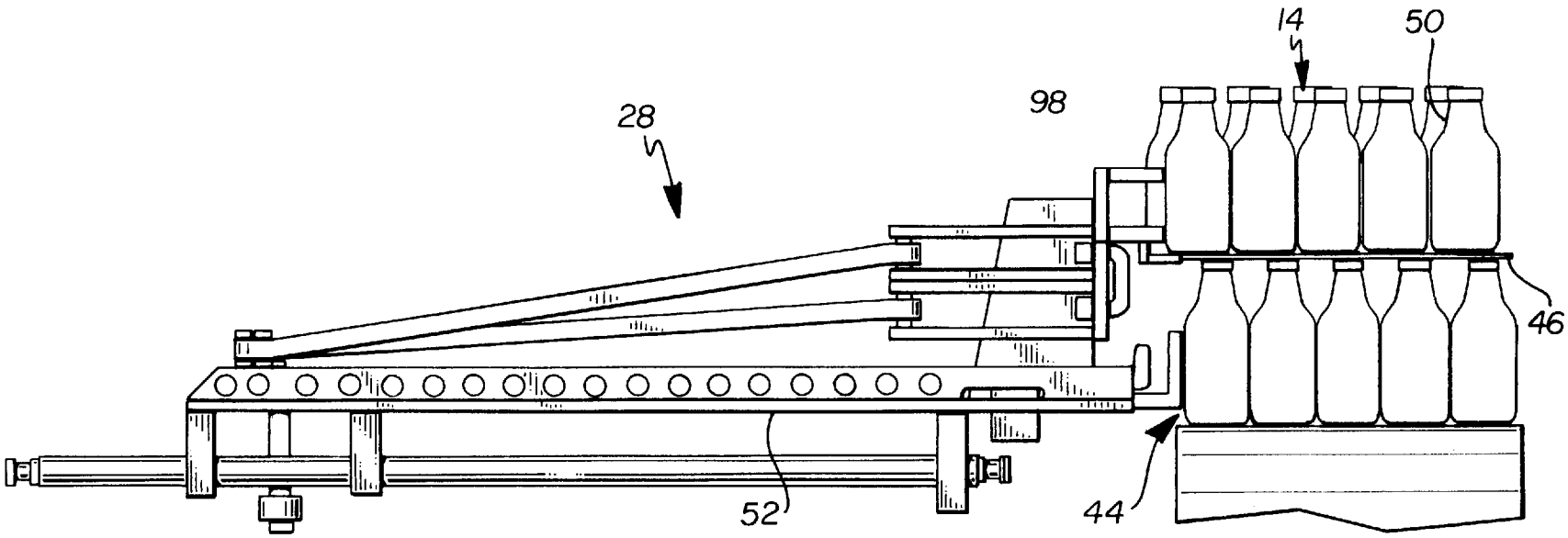
FIG. 7 is a detailed side view of transfer elements and an article group of the cartoning machine of FIG. 6.
Figure 8:
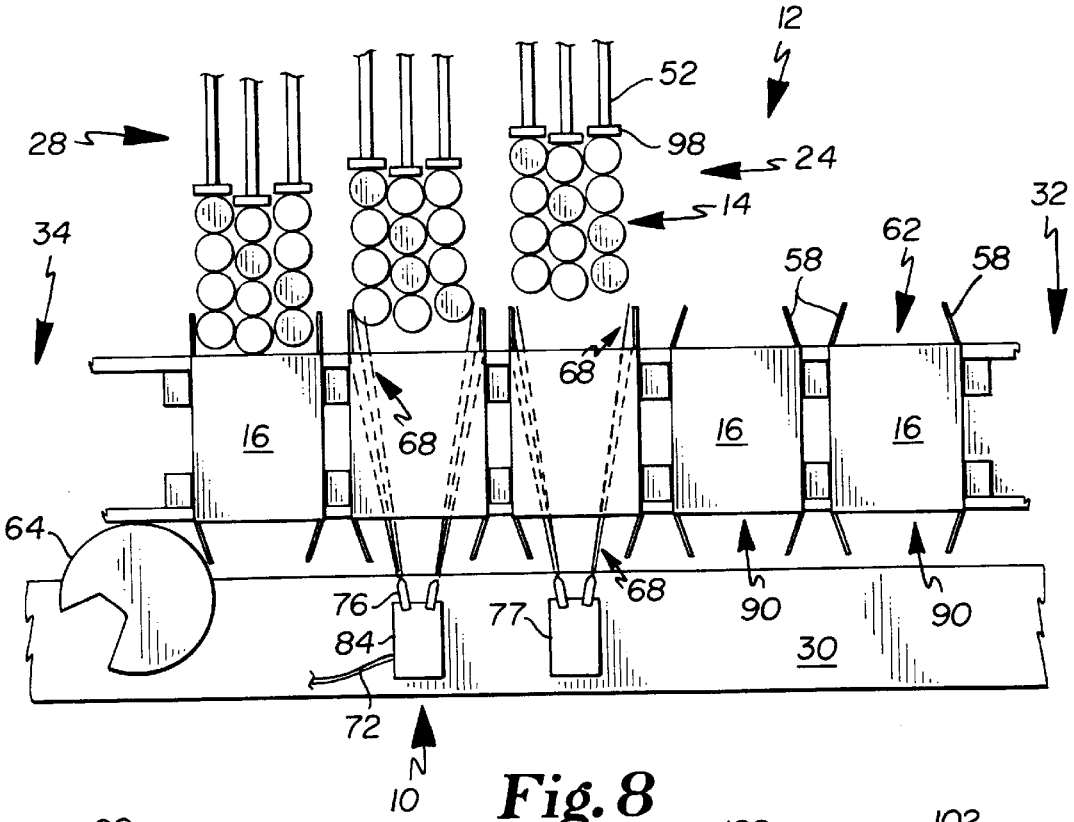
FIG. 8 is a top view of the air jet carton reopening mechanism of the present invention along with the carton transport mechanism and the article group transfer mechanism of the cartoning apparatus of FIG. 6.

The air jet apparatus 10 of the present invention can also be used to carton unstacked article groups such as those processed by the device of Patent '058 or the device of Patent '806. FIGS. 6 and 7 show the cartoner of Provisional Application '930 loading stacked article groups 14 of bottles into carton sleeves 16. The bottle formation is staggered during loading into the carton sleeve 16. An upper group 50 is staggered approximately one third of a bottle diameter behind the lower group 44. Additionally, the center row of the upper group 50 is staggered approximately one third of a bottle diameter behind the outer rows of the upper group 50. Staggering permits improved group loading, a tighter fit of the group when in the package, and also prevents the leading or forward most bottles of the upper group 50 from falling out of the back of the carton sleeve 16. The top bottles tend to lean back into the loading face as the leading edge of the top bottle is supported by the cap on a lower group bottle, while the trailing edge of the top bottle is supported by a divider sheet 46. FIG. 8 is a top view of the air jet apparatus 10. It shows the loading of the stacked article groups 14 and the staggered pattern of the upper group 50, as well as the stepped loader head 98 of the loading arms 52.

Figure 9:
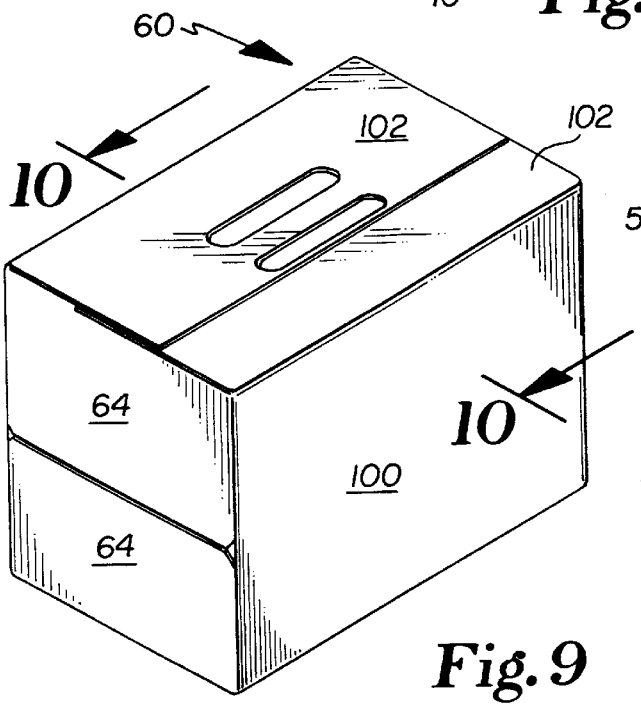
FIG. 9 is a perspective view of an exemplary paperboard carton processed by the device of the present invention having relatively rectangular dimensions.
Figure 10:
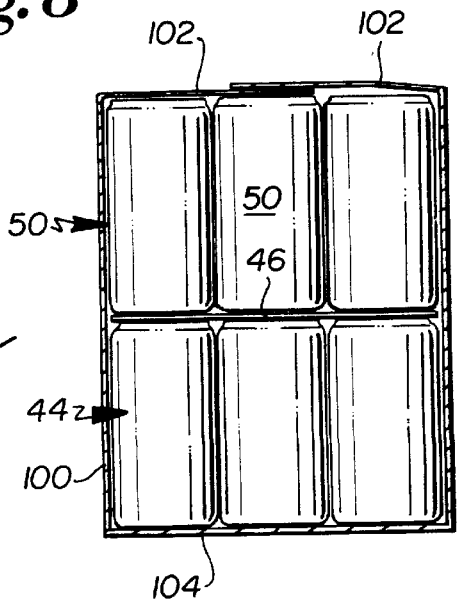
FIG. 10 is a cross-sectional view along line 10—10 of FIG. 9 showing an article group disposed within the optimally sized carton.

Referring to FIGS. 9 and 10, the cartoner 12 constructs carriers or cartons 60 that may contain stacks of cans, bottles, or other articles which are disposed on top of one another. The paperboard carton sleeve 16 is comprised of leading and trailing side panels 100 foldably connected to a top panel 102 and to a bottom panel 104. End panels 66 or flaps connect the top 102, bottom 104 and side 100 panels. A paperboard divider sheet 46 separates the upper group 50 and lower group 44.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim is expressed as a means or step for performing a specified function it is intended that such claim be construed to cover the corresponding structure, material, or acts described in the specification and equivalents thereof, including both structural equivalents and equivalent structures.

That which is claimed is:

1. An air jet apparatus for loading article groups into cartons, each of said cartons being constructed from a carton sleeve, said carton sleeve having an open first end and an open second end, said carton sleeve further having a first set of end panels positioned at said first end and a second set of end panels positioned at said second end, said article groups being loaded into said carton sleeve through said open first end, comprising:

(a) a gas emitting mechanism constructed and arranged to produce a directed stream of pressurized air of a predetermined force;

(b) means to supply gas to said gas emitting mechanism;

(c) a positioning mechanism constructed and arranged to dispose said gas emitting mechanism operationally adjacent to said second end of said carton sleeve;

(d) an aligning mechanism constructed and arranged to adjustably direct said stream of pressurized air produced by said gas emitting mechanism from said second end through said carton sleeve toward said first end to extend said first set of end panels of said carton sleeve; and (e) a timing mechanism constructed and arranged to produce a pulsating stream of pressurized air, said timing mechanism producing said pulsating stream of pressurized air and extending said first set of end panels as said article group is being loaded into said first end of said carton sleeve.

2. The air jet apparatus of claim 1, wherein said gas emitting mechanism includes one or more air jet nozzles.

3. The air jet apparatus of claim 1, wherein said means to supply gas includes an air line.

4. The air jet apparatus of claim 1, wherein said positioning mechanism includes a support arm.

5. The air jet apparatus of claim 1, wherein said aligning mechanism comprises one or more pivoting mechanisms constructed and arranged to pivotally mount said gas emitting mechanism and adjustably direct said stream of pressurized air in a fixed direction.

6. The air jet apparatus of claim 1, wherein said timing mechanism comprises a programmable electronic device.

7. The air jet apparatus of claim 6, wherein a longitudinal stream of carton sleeves are transported past said gas emitting mechanism, said programmable electronic timing device producing said pulsating stream of pressurized air for a predetermined duration of time for each of said carton sleeves, said programmable electronic timing device synchronizing said pulsating stream of pressurized air with said stream of carton sleeves enabling said stream of pressurized air to flow through said carton sleeve.

8. A cartoning apparatus for loading article groups into cartons, each of said cartons being constructed from a carton sleeve, said carton sleeve having an open first end and an open second end, said carton sleeve further having a first set of end panels positioned at said first end and a second set of end panels positioned at said second end, said article groups being loaded into said carton sleeve through said open first end, comprising:

(a) an article group transport mechanism constructed and arranged to transport a longitudinal stream of article groups;

(b) a carton transport mechanism disposed adjacent to and parallel with said article group transport mechanism, said carton transport mechanism being constructed and arranged to provide a longitudinal stream of said carton sleeves, each of said carton sleeves having said open first end facing and synchronized with said article group transport mechanism;

(c) an article group loading mechanism constructed and arranged to move a plurality of article groups from said article group transport mechanism into said first open end of each of said carton sleeves traveling on said carton transport mechanism; and (d) an air jet apparatus disposed adjacent to said carton transport mechanism and opposite from said article group loading mechanism, said air jet apparatus directing a stream of pressurized air through each of said carton sleeves traveling on said carton transport mechanism, said stream of pressurized air flowing through said open second end and said carton sleeve and extending said first set of end panels.

9. The cartoning apparatus of claim 8, wherein said article group loading mechanism moves in parallel synchronization with said article group transport mechanism, said article group loading mechanism comprising support means, movable pushing means operative in a transverse direction, and activation means to move said pushing means at predetermined positions in a travel path.

10. The cartoning apparatus of claim 8, wherein said air jet apparatus comprises:

(a) a gas emitting mechanism constructed and arranged to produce a directed stream of pressurized air of a predetermined force;

(b) means to supply gas to said gas emitting mechanism;

(c) a positioning mechanism constructed and arranged to dispose said gas emitting mechanism operationally adjacent to said carton transport mechanism and opposite from said article group loading mechanism;

(d) an aligning mechanism constructed and arranged to adjustably direct said stream of pressurized air produced by said gas emitting mechanism from said second end through said carton sleeve toward said first end to extend said first set of end panels of said carton sleeve; and (e) a timing mechanism constructed and arranged to produce a pulsating stream of pressurized air, said timing mechanism producing said stream of pressurized air and extending said first set of end panels as said article group is being loaded into said first end of said carton sleeve.

11. The cartoning apparatus of claim 8, further comprising an article infeed mechanism constructed and arranged to supply at least two streams of articles, each at a predetermined vertically distinct level, wherein said article group transport mechanism intersects said article infeed mechanism to form and transport said longitudinal stream of article groups of a predetermined stacked pattern, and said article group loading mechanism side loads a plurality of stacked article groups into said plurality of carton sleeves.

12. A cartoning apparatus for loading article groups into cartons, each of said cartons being constructed from a carton sleeve, said carton sleeve having an open first end and an open second end, said carton sleeve further having a first set of end panels positioned at said first end and a second set of end panels positioned at said second end, said article groups being loaded into said carton sleeve through said first end, comprising:

(a) an article group transport mechanism constructed and arranged to transport a longitudinal stream of article groups;

(b) a carton transport mechanism disposed adjacent to and parallel with said article group transport mechanism, said article group transport mechanism being constructed and arranged to provide a longitudinal stream of said carton sleeves, each of said carton sleeves having said open first end facing and synchronized with said article group transport mechanism;

(c) an article group loading mechanism constructed and arranged to move a plurality of article groups from said article group transport mechanism into said first open end of each of said carton sleeves traveling on said carton transport mechanism; and (d) an air jet apparatus comprising: a gas emitting mechanism constructed and arranged to produce a directed stream of pressurized air of a predetermined force; means to supply gas to said gas emitting mechanism; a positioning mechanism constructed and arranged to dispose said gas emitting mechanism operationally adjacent to said carton transport mechanism and opposite from said article group loading mechanism; an aligning mechanism constructed and arranged to adjustably direct said stream of pressurized air produced by said gas emitting mechanism from said second end through said carton sleeve toward said first end to extend said first set of end panels of said carton sleeve; and a timing mechanism constructed and arranged to produce a pulsating stream of pressurized air, said timing mechanism producing said stream of pressurized air and extending said first set of end panels as said article group is being loaded into said first end of said carton sleeve.

13. A method for opening cartons to receive an article group, each of said cartons being constructed from a carton sleeve, said carton sleeve having an open first end and an open second end, said carton sleeve further having a first set of end panels positioned at said first end and a second set of end panels positioned at said second end, said article groups being loaded into said carton sleeve through said open first end, comprising the steps of:

(a) producing a stream of pressurized air of a predetermined force; and (b) directing said stream of pressurized air through said open second end and said carton sleeve to extend said first set of end panels.

14. The method for opening cartons to receive an article group, as recited in claim 13, wherein said step of producing said stream of pressurized air includes the step of flowing compressed air through one or more air jet nozzles, and said step of directing said stream of pressurized air includes the step of pivoting said air jet nozzles.

15. The method for opening cartons to receive an article group, as recited in claim 13, further comprising the step of aligning said stream of pressurized air to open said carton.

16. The method for opening cartons to receive an article group, as recited in claim 13, further comprising the step of synchronizing said stream of pressurized air with the loading of said article group into said carton sleeve.

17. A method for opening cartons to receive article groups for packaging in a continuous motion cartoning apparatus, each of said cartons being constructed from a carton sleeve, said carton sleeve having an open first end and an open second end, said carton sleeve further having a first set of end panels positioned at said first end and a second set of end panels positioned at said second end, said article groups being loaded into said carton sleeve through said first end, comprising the steps of:

(a) producing a stream of pressurized air of a predetermined force using a gas emitting mechanism;

(b) directing said stream of pressurized air at carton sleeves traveling on a carton transport mechanism of said continuous motion cartoning apparatus;

(c) aligning said stream of pressurized air to flow through said second end and said carton sleeve to extend said first set of end panels; and (d) synchronizing said stream of pressurized air with the loading of said article group into said carton sleeve.

* * * * *